US009984535B2

(12) United States Patent
Odom

(10) Patent No.: US 9,984,535 B2
(45) Date of Patent: May 29, 2018

(54) METHOD AND SYSTEM FOR PROVIDING FANTASY COMPETITIONS

(71) Applicant: James M. Odom, Arroyo Seco, NM (US)

(72) Inventor: James M. Odom, Arroyo Seco, NM (US)

( * ) Notice: Subject to any disclaimer, the term of this patent is extended or adjusted under 35 U.S.C. 154(b) by 24 days.

(21) Appl. No.: 15/078,844

(22) Filed: Mar. 23, 2016

(65) Prior Publication Data

US 2017/0098348 A1 Apr. 6, 2017

Related U.S. Application Data

(60) Provisional application No. 62/236,005, filed on Oct. 1, 2015.

(51) Int. Cl.
*G07F 17/32* (2006.01)

(52) U.S. Cl.
CPC ..... *G07F 17/3288* (2013.01); *G07F 17/3244* (2013.01); *G07F 17/3279* (2013.01)

(58) Field of Classification Search
CPC ..... G07F 17/3288; G07F 17/3244; G07F 17/3279; A63F 13/828
See application file for complete search history.

(56) References Cited

U.S. PATENT DOCUMENTS 6,371,855 B1 * 4/2002 Gavriloff ..... A63F 13/12 463/1
7,351,150 B2 4/2008 Sanchez
7,699,707 B2 4/2010 Bahou
7,922,570 B2 4/2011 Prado
8,177,644 B2 5/2012 Anderson et al.
8,192,260 B2 6/2012 Fleming
8,315,722 B1 11/2012 Russo
8,512,148 B2 8/2013 Butz et al.
8,548,611 B2 10/2013 Ahlstrom
8,668,561 B2 3/2014 Hansen et al.
8,678,930 B2 3/2014 Gabrail et al.
8,795,045 B2 8/2014 Sorrells et al.
(Continued)

FOREIGN PATENT DOCUMENTS

WO 2005000436 A1 1/2005

*Primary Examiner* — Dmitry Suhol
*Assistant Examiner* — Carl V Larsen
(74) *Attorney, Agent, or Firm* — Scheinberg & Associates, P.C.; John B. Kelly

(57) ABSTRACT

A method and system for providing a fantasy competition, in which the method includes determining a set of real-world players eligible for scoring in a fantasy competition; assigning a value for each of the real-world players; determining a salary cap for the fantasy competition; randomly assigning real-world players to a team roster; performing a draft in which the participants select real-world players who were not randomly assigned to a team roster; randomly assigning one or more real-world players to a taxi squad; receiving an indication of the real-world players assigned to the active roster; determining whether the combined value of the real-world players assigned to the active roster exceeds the salary cap; and performing a fantasy competition in which a score for each team roster associated with a participant is based on the performance, in one or more real-world events, of the real-world players assigned to the active roster.

30 Claims, 2 Drawing Sheets

(56) References Cited

U.S. PATENT DOCUMENTS

| | | | | |
|---|---|---|---|---|
| 2002/0046137 | A1 | 4/2002 | Odom et al. | |
| 2004/0266513 | A1 | 12/2004 | Odom et al. | |
| 2005/0164792 | A1 | 7/2005 | Wilcock | |
| 2007/0067232 | A1 | 3/2007 | Odom et al. | |
| 2007/0073609 | A1 | 3/2007 | Odom et al. | |
| 2008/0161113 | A1 | 7/2008 | Hansen et al. | |
| 2010/0184495 | A1 | 7/2010 | Levy et al. | |
| 2010/0203935 | A1 | 8/2010 | Levy et al. | |
| 2010/0210330 | A1 | 8/2010 | Fleming | |
| 2010/0248805 | A1 | 9/2010 | Odom et al. | |
| 2011/0028195 | A1 | 2/2011 | Pennington et al. | |
| 2011/0098096 | A1 | 4/2011 | Odom et al. | |
| 2011/0165946 | A1* | 7/2011 | Pavlich | G07F 17/32 463/42 |
| 2012/0270614 | A1 | 10/2012 | Robinson | |
| 2012/0295685 | A1 | 11/2012 | Odom et al. | |
| 2013/0045805 | A1 | 2/2013 | Pennington et al. | |
| 2013/0079094 | A1 | 3/2013 | Odom et al. | |
| 2013/0260898 | A1* | 10/2013 | Pepe | A63F 13/005 463/42 |
| 2014/0066159 | A1 | 3/2014 | Odom et al. | |
| 2014/0206455 | A1 | 7/2014 | Gabrail et al. | |
| 2015/0065257 | A1 | 3/2015 | Jolliffe | |
| 2016/0051895 | A1* | 2/2016 | Hood | A63F 13/35 463/29 |
| 2017/0136365 | A1* | 5/2017 | Hwang | A63F 13/828 |
| 2017/0161999 | A1* | 6/2017 | Givant | G07F 17/3288 |

* cited by examiner

METHOD AND SYSTEM FOR PROVIDING FANTASY COMPETITIONS

TECHNICAL FIELD OF THE INVENTION

The present invention relates to fantasy competitions such as online fantasy sports, fantasy e-Sports, and the like.

BACKGROUND OF THE INVENTION

A fantasy sport (also known less commonly as rotisserie or roto) is a type of competition where participants assemble imaginary or virtual teams of one or more real players of a professional or amateur sport. The fantasy teams compete based on the statistical performance of the real players in actual games. The performance of each real players is converted into points that are compiled and totaled according to a roster selected by each participant managing a fantasy team. The points are compiled and calculated using computers tracking actual results of the sport. In fantasy sports, team owners can draft, trade and cut (drop) players, analogously to real sports. Fantasy sports are played on a daily basis, or on a season-long basis.

Fantasy sports, as it is now played, is primarily a data driven game where statistic grinders, fantasy sports players who spend a significant amount of time analyzing fantasy sports statistics, have a distinct advantage over casual players. This is where there is a skill gap problem with the advanced statistical based fantasy contest models used today. There are lineup optimizers widely available and if a casual player not playing optimal lineups happens to face participants that are putting in volume entries with optimal lineups, the odds are the casual player won't last long in the games.

Electronic sports (also known as eSports, esports, e-sports, competitive (video) gaming, professional (video) gaming, or pro-gaming) can be defined as a form of sports where the primary aspects of the sport are facilitated by electronic systems. The input of players and teams as well as the output of the eSports system are mediated by human-computer interfaces. Most commonly eSports take the form of organized multiplayer video game competitions, particularly between professional players. The most common video game genres associated with eSports are real-time strategy, fighting, first-person shooter (FPS), and multiplayer online battle arena (MOBA). Tournaments such as The International, the League of Legends World Championship, the Battle.net World Championship Series, the Evolution Championship Series, and the Intel Extreme Masters, provide both live broadcasts of the competition, and prize money and salaries to competitors.

SUMMARY OF THE INVENTION

Embodiments of the present invention are directed to a method for providing a fantasy competition. The method comprises determining a set of real-world players eligible for scoring in a fantasy competition; assigning a value for each of the real-world players in the set of real-world players; determining a salary cap for the fantasy competition, the salary cap comprising a limit on a sum of the values of the real-world players selected for an active roster; randomly assigning real-world players to a team roster associated with a participant of a fantasy competition, the team roster comprising the active roster and a taxi squad; subsequent to randomly assigning real-world players to a team roster associated with a participant of a fantasy competition, performing a draft in which the participants select real-world players from the set of position players who were not randomly assigned by the exchange to a team roster associated with a participant; randomly assigning one or more real-world players to a taxi squad associated with a participant of a fantasy competition; receiving, for each team roster associated with a participant, an indication of the real-world players assigned to the active roster, the performance of the real-world players assigned to the active roster being used for scoring the fantasy competition; determining whether the combined value of the real-world players assigned to the active roster exceeds the salary cap; and performing a fantasy competition in which a score for each team roster associated with a participant is based on the performance, in one or more real-world events, of the real-world players assigned to the active roster associated with the team roster.

Embodiments of the present invention are also directed to a computer system for providing a fantasy competition. The computer system comprises a computer processor and a computer-readable memory communicatively coupled to the processor. The computer-readable memory is encoded with computer-executable instructions that, when executed by the computer processor, cause the computer system to perform the steps of: determining a set of real-world players eligible for scoring in a fantasy competition; assigning a value for each of the real-world players in the set of real-world players; determining a salary cap for the fantasy competition, the salary cap comprising a limit on a sum of the values of the real-world players selected for an active roster; randomly assigning real-world players to a team roster associated with a participant of a fantasy competition, the team roster comprising the active roster and a taxi squad; subsequent to randomly assigning real-world players to a team roster associated with a participant of a fantasy competition, performing a draft in which the participants select real-world players from the set of position players who were not randomly assigned by the exchange to a team roster associated with a participant; randomly assigning one or more real-world players to a taxi squad associated with a participant of a fantasy competition; receiving, for each team roster associated with a participant, an indication of the real-world players assigned to the active roster, the performance of the real-world players assigned to the active roster being used for scoring the fantasy competition; determining whether the combined value of the real-world players assigned to the active roster exceeds the salary cap; and performing a fantasy competition in which a score for each team roster associated with a participant is based on the performance, in one or more real-world events, of the real-world players assigned to the active roster associated with the team roster.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

DETAILED DESCRIPTION OF PREFERRED EMBODIMENTS

Figure 1:
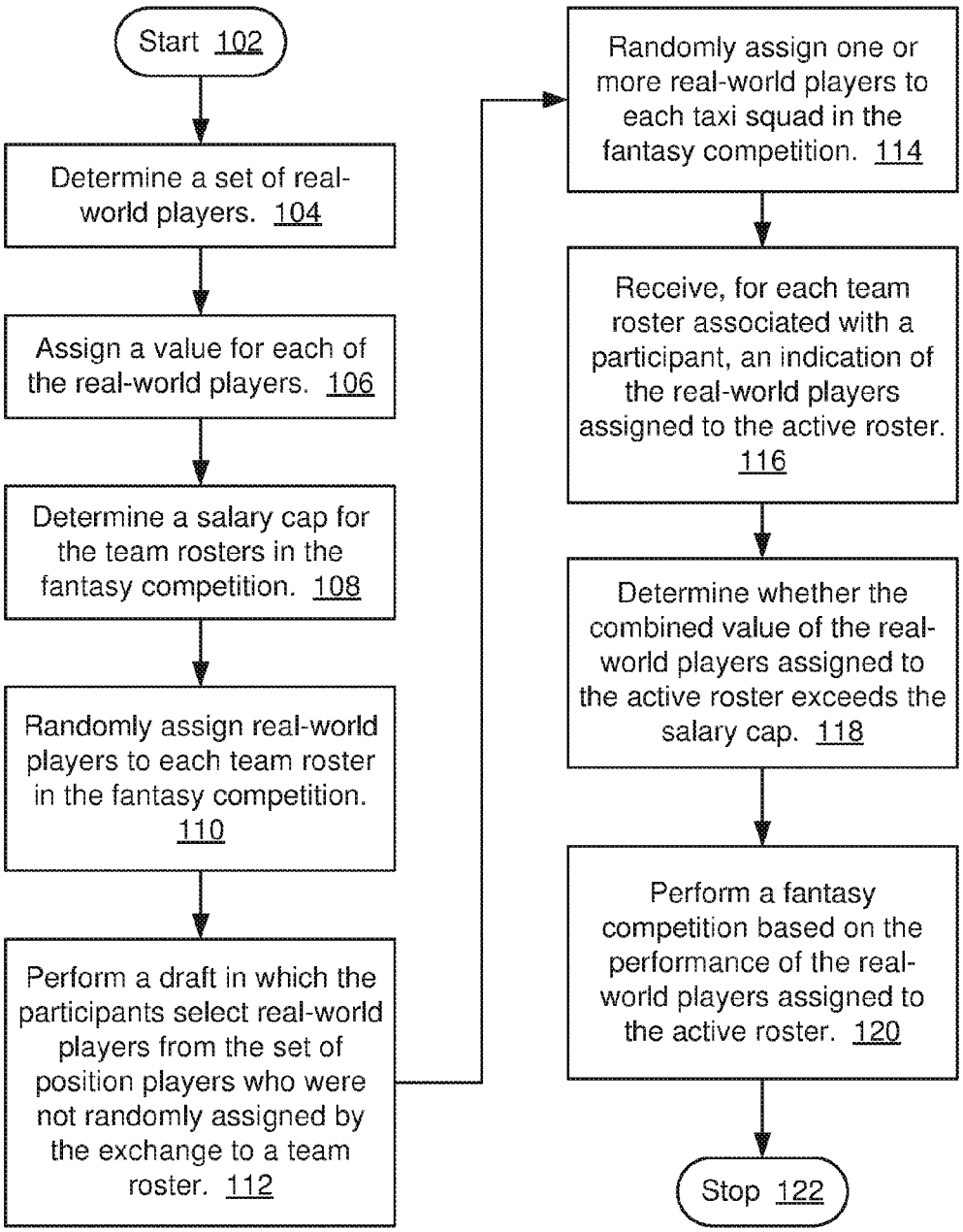
FIG. 1 is a flowchart showing a computer-implemented method in accordance with one or more embodiments of the present invention.

Preferred embodiments of the present invention are directed toward improved methods and systems for providing fantasy competitions. Preferred embodiments include a transparent exchange style fantasy trading and wagering system. The wagering exchange provides a marketplace for matching wagers where participants/bettors can buy and sell the outcome of an event, can wager in real-time throughout the event, and can trade out to cut loses or lock in a profit on the event. The exchange may or may not charge a transaction fee. The exchange trading and wagering system can provide and process head-to-head, multiple player, tournament, season-long, leagues, teams, daily, and all other competitive style fantasy/eSport competitions or events, with or without exchange fees and salary caps. In relevance to embracing sports fans and their fan passion for their favorite team, an embodiment will allow participants to pick their favorite players from their favorite real-world team to be matched against other participants' favorite team players. Participants can use the exchange to provide a variety of services as designated by the rules of the event set by the exchange, or by the participants themselves involved in the event. This would include the exchange being a depository and disbursing/clearing mechanism to debit/credit the participants accounts of money, bonus points, credits, overlay winnings, play money, certificates, coupons, and any type virtual currency or virtual value adding items (such as "skins" in eSports) to an event, etc. according to participant's wins or loses, or by the rules of the event. Also, the exchange can include a platform for trading, buying, and selling of wagers between participants of an event, spectators, and the exchange, and any combination of the three. The exchange will also provide odds (fixed odds as well as win probability of these fixed odds), spread wagers, wagering lines, and the return on a specific amount bet. The win probability of fixed odds will help reduce the mystification of fixed odds wagering for participants not familiar with wagering. For example, a participant may not be able to answer the question "what is the win probability of an odds line of 4-to-1?" The win probability of an odds line of 4-to-1 is 20%.

The exchange can also provide binary wagering/hedging (also known as prediction markets, idea futures, event derivatives, etc.). Binary wagering (the binary will expire at the price of 0 or 100%, that is, either the occurrence happened or the occurrence did not happen) offered by the exchange can not only provide "wisdom of crowds" (i.e., what the crowd thinks the probability of a occurrence happening pertaining to a specific event) for specific players in events, or specific occurrences within an event, but can also serve as a hedging mechanism for participants on individual players or specific occurrences. The exchange can provide the buying, selling, and trading of fantasy game tokens, virtual currency, virtual value items, fantasy stocks, futures, options, or any other type fantasy financial derivative that is a fantasy game or competition based on a real-world event.

The exchange can provide the real-time clearing of such trades/wagers between participants or between participants and the exchange. An event could be all types of fantasy events such as athletic, eSports, entertainment, online gaming, and social as well as real world events. The exchange would allow the participants/bettors to set their own specific events/wagers with their own rules, odds, betting line, etc., or the event could be an exchange event with the exchange setting the rules. For example, a higher rated participant might offer a lower rated participant 3-to-1 odds that the higher rated participant could win the fantasy competition. The exchange can elect to charge a small percent of the money transacted on an event, charge a fixed fee, or not charge at all.

An embodiment of the exchange can provide a totally transparent trading and wagering exchange floor (including all charges by the exchange) that can provide accounting done in real-time with a no-default clearing mechanism that provides two functions. The first function is the accountability of all trades and wagers on the exchange floor, as well as the real-time updating of the individual participant's/bettor's financial status in real money as well as fantasy funds. This would include at the point of a trade or wager the real-time confirmation and allocation of all trades, wagers, and fantasy salary cap data with time stamped entries and exits occurring on the exchange floor as well as all related fantasy and real world financial bankroll data of the participant such as all current open and closed wagers and trades, daily wagering and trading history, available funds, and current profit and loss status in-running and real-time. This will be maintained for season-long league play as well as daily sports play. The second function is to guarantee trade/wager completion. After a wager is agreed upon, the clearing process guarantees both parties are bound to the process by initiating a search to determine there is sufficient funds in the participant's accounts to make the wager. If this requirement is met, then a "lock" is placed on the wagering funds and transferred to the exchange's wager escrow account until the outcome of the wager is determined. Upon determining the outcome of the wager, clearing will debit the loser's account and credit the winner's account in the amount of the wager, minus a transaction fee (if there is one). The same type clearing will occur in the fantasy realm after a trade is negotiated for a player at a set or negotiated price, the clearing process guarantees that the buyer has made a purchase and the seller has made a sale by searching to insure the participants have sufficient funds and salary cap parameters must be met. Then funds and players are locked for a trade (buy, sell, or trade involving funds and/or players) between participants, or between participants and the exchange. If requirements are met the trade is consummated between all concerned parties by debiting and crediting funds and players on and off rosters/exchange, thus insuring no-default trading and wagering executed substantially in real-time.

The exchange provides transparent risk management for funds and player selection for the participant by evaluating/comparing the participant's intentional selection to a model provided by the exchange for individual players. By using algorithm projections on a player's attributes, the exchange sizes the exposures to improve the quality and consistency of the participant's returns. The exchange can measure various exposures for the participant, such as rating the performance of other participants (e.g., win/loss record, number of games the participant has entered, etc.) or monitoring news stories or social media mentions by experts in the field, ownership percentages, binary markets (wisdom of crowd markets), contrary opinion markets, or any other form of data that will provide collective intelligence of the real world players involved in the event(s) that is (are) the subject of the fantasy competition. The system can succinctly assimilate the selection of such exposures and provide a real-time, in-running evaluation that can be presented in a win probability or fixed odd format, or statistical probability of a selection providing increased value (score points, etc.) to the participant's lineup that would be separate and apart from the real-time performance rated dollar value of a player that serves as a gauge for value buying, selling, and trading by participants that is provided by the exchange.

With an exchange trading system supplying real-time value/performance rating combined with transparent risk management tools, and the continual buying, selling and trading of players throughout season-long leagues and daily fantasy, the casual participant is put on a more level playing field with the statistic grinders. The fantasy team position players are valued and performance-rated and win/statistical probability-rated in real-time during the specific games for transparency and for all participants to have access to which fantasy team position player is playing well and who is not. This will be reflected in the current dollar value and probability of the position player on the exchange. This will also diminish the need for participants to use powerful third party services and scripted optimal lineups to gain distinct advantage over other participants because real-time statistical modeling will be combined in the real time evaluation of player performance and value (price). It is evident that highly rated real world athletes can have a bad game and lesser known athletes can have a break out game at any given event. Embodiments of the present invention enable game play that is fun and a matter of trading skill and deal making by using current valuations without regard to doing hours of research on all of the players' season statistics.

Embodiments of the present invention are directed to a new fantasy/eSports model of exchange-traded, real-time value and performance-rating of the real-world athletes and competitors involved in fantasy/eSports events that integrates as many as three or more phases of action to provide a new generation of fantasy sports games for competitors. The exchange user interface will provide a real-time, in-running (i.e., trading/wagering while the real-time event is actually being conducted) player-trading/wagering exchange for buying, selling, or trading of players between participants, or between participants and the exchange. Real-time valuations of events or players can be used for exchange wagering embodiments whereby all types of binary wagers, wagering lines or odds on games, individual performances, and specific events occurring during games or events, such was what the next play might be or if a basket is made, can be updated and can be wagered on in real-time as the game or event unfolds. eSports, such as video game competitions, online video game competitions, massively-multiplayer online game ("MMOG") competitions, or virtual or simulated sports would be particularly adaptable to the real-time valuations/odds and trading/wagering environment due to the fast pace of play. Embodiments also lend themselves to daily fantasy head-to-head competition and season long fantasy leagues with or without exchange fees and salary caps, elimination tournament style playing, and all other competitive style fantasy events. Embodiments also enable fan engagement by providing a fast action, highly entertaining platform with multiple players for the less serious fantasy/eSports gamers of games such as Madden NFL, NBA 2K16, League of Legends, Defense of The Ancients (DOTA), etc., or fantasy entertainment enthusiasts that want to test their skills with or without wagering.

Described in further detail below is an embodiment of a daily fantasy three phase exchange-trading example, where the exchange is setting the rules for the event. Another embodiment would allow the participants involved in the event to set the rules for the competition and wagering. This exemplary embodiment is described based on fantasy football, such as a fantasy football competition based on the National Football League ("NFL") or the National Collegiate Athletics Association ("NCAA"), but can be readily adapted to any competition (team or individual) in which statistics related to are readily available, such as eSports, hockey, soccer, basketball, baseball, motorsports (e.g., NASCAR, Formula One), golf (e.g. PGA), tennis, track and field events, the Olympics, rugby, cricket, rodeo (such as bronco-riding, bull-riding, calf-roping, barrel-racing, and the like), and equestrian sports (such as horse-racing, steeplechase, and the like) and all other varieties of sports and competitions. The first phase of the exemplary daily fantasy football embodiment begins with the random assignment, by the exchange, of real-world position players from specific teams to rosters of the fantasy participants to insure a full roster of randomly selected real-world football players before a draft. The second phase is a player draft. After the randomly selected rosters are set and the participants are aware of which players were randomly assigned to their rosters, a draft is conducted from a pool of position players from the real-world teams. The pool of position players from the real-world teams is selected by the exchange for this specific fantasy event. The exchange is the operator of the fantasy sports competition. The draft gives the participants the opportunity to buy, sell, and trade for draft rounds as well as for the position players of their choice to create their best starting team. After the draft, a "taxi" squad is randomly assigned by the exchange to each participant to maintain a full roster during roster bargaining by participants. The player/players on the taxi squad will come with a value assigned by the exchange, but at no charge to the salary cap of the participants. These taxi squad members may be sold or traded to the exchange or other participants for any position players or activated to the participants playing roster. Special rules for taxi squad members and pool position players that score or acquire deficit points will apply and be addressed in their respective section coverage. The exchange will determine the number of taxi squad players assigned to each participant's roster depending on the format of the contest. The third phase is the real-time buying, selling, and trading of the position players on the exchange by the opponents to have the winning roster at the conclusion of the designated real-world games for this specific fantasy event. This phase is where in-running wagering between the exchange and participants, or between the participants themselves, can occur.

The exchange serves as a "market maker" and provides "liquidity" via the real-time value and performance-rated buy or sell pricing to the participants by the exchange for all real-world players involved in a specific fantasy contest. The exemplary embodiment described in further detail below describes a daily fantasy head-to-head competition with a salary cap. A participant therefore knows the price at which he can sell a player to the exchange at any given time and receive a credit to his salary cap in the amount for which he sold the player. Conversely, a participant knows what any player would cost him to buy from the exchange, and that amount to purchase the player will be deducted from the salary cap of the participant's team. This pricing of real world position players by the exchange will serve as a gauge of value when participants trade among themselves for players they desire on their roster, that are currently on their opponent's roster. Because the exchange also serves as a bid-ask trading platform, participants can make offers for players at a price that is higher or lower than the price set by the exchange to other participants. The exchange has an unrestricted amount of play money to provide liquidity and player value. Player value is the real-time price based on real-time performance of all individual players in the player pool.

Before the random assignment of position players by the exchange, the participants will know who the entire pool of real-world position players are, and the value the exchange places on them. For assignment purposes, each position that comprises the team will be assigned a specific set of numbers. One number from this set of numbers will be assigned to each position player. Each position set of numbers will be randomized so the participant will not know which player he will be assigned. The exchange selects one number from each set of position player numbers to assign to each participant. The number selection and assigning process by the exchange is repeated through the entire position player selections. This allows the participants to have a complete position player roster that was randomly selected before the draft. Each participant will have a "taxi" squad assigned to their roster by the exchange after the draft. The assigned roster helps level the playing field between the participants for the draft, as well as provide an impetus for stimulated buying, selling and trading between participants, and between participants and the exchange.

The first phase of an exemplary daily fantasy football embodiment consists of the exchange doing a randomized assignment of known position players with assigned player values to fill the roster of the participants. The exchange will select and number randomize the real-world players for the assignment from a specific number of real-world games that comprise a specific fantasy event. The exchange will also set the size of the roster, the number of players on the taxi squad, the required positions to be on the roster, the number of players from each position to comprise the roster, the number of players from each position available for selection (total size of the pool of position players), whether there is a salary cap or not for the roster, and the value of the salary cap.

This exemplary daily fantasy football event will be a head-to-head competition where the two participants, A and B, each strive to have the highest rated team as determined by the scoring system set by the exchange at the end of play of the designated games. The exchange sets a four game, eight team (the teams in this example are all playing in the 4 games) total pool of real-world position players from which the exchange arbitrarily selects 52 position players that can be used to create a team by each of the two opponents. The exchange puts a monetary value and performance rating on each of the selected 52 players. The exchange designates a seven-man roster with one taxi squad player, with a $7,000 salary cap. The roster must consist of a quarterback, two wide receivers, one running back, one kicker, one tight end, and one defensive back/special teams player.

The exchange assigns to the seven quarterbacks it has arbitrarily chosen from the designated eight teams the numbers 1 to 7, the fourteen wide receivers the numbers 8 to 22, the seven running backs numbers 23 to 30, the seven kickers numbers 31 to 38, the seven tight ends numbers 39 to 45, and the seven defensive backs/special team players 46 to 52. The exchange then randomly selects a number for each participant from each group of position players to fill out the rosters of the two participants. The participants could have simulated dice rolled on screen with the highest dice number being the first assignee of a player by the exchange.

The random selection of numbers could be shown visually onscreen by any form of randomization, for example, by a virtual character that turns a hopper and a number pops out from the designated set of numbers for quarterback. Participant A is assigned quarterback number 5 with a value of $1200, participant B was assigned number 1 with a $650. The next round A is randomly assigned number 13, a $500 receiver, B is randomly assigned number 11, a $1025 receiver, then A is randomly assigned number 22, a $900 receiver, and B is randomly assigned number 17, a $850 receiver. Participant A has two receivers, numbers 13 and 22 with a total cost of $1400, while participant B has two receivers, numbers 17 and 11 with a total cost of $1875. In the next round, participant A is randomly assigned number 27, a running back for $1000, and participant B is randomly assigned number 30, a running back for $800. The next three rounds have A randomly assigned number 32 for $900, number 40 for $600, and number 47 for $900 to complete his roster with a kicker, a tight end, and a defensive back/special teams player. Participant B is randomly assigned kicker number 34 for $800, tight end 39 for $1000, and defensive back/special team player 52 for $700. At this point, two participants' randomly assigned playing rosters are complete. The randomly-assigned roster of participant A consists of players 5, 13, 22, 27, 32, 40, and 47 having a roster valued at $6000. The randomly-assigned roster of participant B consists of players 1, 11, 17, 30, 34, 39, and 52 having a roster value of $5825. Both participants received quality players during the random assignment of players.

The second phase of an exemplary daily fantasy football embodiment consists of a draft from the remaining pool of position players who were not randomly assigned by the exchange to the participants. The two opponents are starting the draft phase with a complete roster of position players that was randomly assigned to them by the exchange. The position players on the roster can be sold or traded at designated times during, and after, the draft. This simulates a real-world NFL team developing their roster. Room on the roster, and staying under the salary cap limit, must be made for the more desirable position players by the participant by either selling or trading the less desirable ones to the exchange, or to their opponent.

In this exemplary daily fantasy embodiment, a seven player roster is used to complete the team. The rules set by the exchange might be that the draft is a three round draft with a coin flipped or dice rolled (simulated) to see which participant goes first. The participants are starting with a roster and salary cap so they have to buy, sell, and trade to get players they want. The exchange sets the rules for how many rounds the draft is. The draft could alternatively be a two round draft to stimulate more trading action (buying/selling) after the draft was over, or a seven round draft that would facilitate the trading of draft rounds for players and money. That is, participants can trade players, money, and draft picks. Also, when there are more participants in a particular fantasy event the trading of draft rounds, players, and money between participants can be simulated just like teams do between each other on draft day in the NFL.

The participant who goes first will offer to sell or trade a player he doesn't want in order to make room for a player he wants. The exchange will respond and provide liquidity by offering to buy the player in question and sell the participant another player if the participant's opponent doesn't want to buy or trade for the player that the participant is offering for sale or trade. This process alternates between the two participants for the three rounds as determined by the exchange. After the three rounds, the exchange randomly picks one player for each participant from the position player pool to assign to the participant's taxi squad. The taxi squad player will come with his assigned value but at no charge to the salary cap of the participant. This participant then has the option of immediately selling or trading the taxi squad member to the exchange or other participant if it is not a desirable player as long as the salary cap is not exceeded. This can be done so that the most desirable line up and taxi squad for a full roster is maintained for potential trades in case a taxi squad member is activated to the regular team replacing a regular team member, who must be the same position player as the taxi squad member, to maintain a fully required lineup. The deactivated player can then remain on the taxi squad or be sold or traded to the exchange or to the other participant for any position player, who can immediately be activated or placed on the taxi squad. All manners of trades can be consummated as long as a full roster and taxi squad member plus salary cap is maintained. Much strategy will be required to maintain the best lineup of position players as the real-world games progress.

In this exemplary daily fantasy embodiment, participant A's roster we see one of his wide receivers, player 13, and his tight end, player 40, probably need to be upgraded. Where participant B's weakness could be is in quarterback, player 1, and his defensive back, player 52. This is based strictly on the way the exchange has valued the players. In this example, B won the right to draft first. His main concern is at quarterback.

DRAFT ROUND ONE: Looking at the pool of quarterbacks, numbers 2, 3, 4, 6, and 7, the top rated quarterback in the league, number 7, is available for $1500 from the exchange. Participant B's quarterback, player 1, is valued at $600 by the exchange so he simultaneously sells his player 1 and purchases player 7 and pays the exchange the $900 difference. His salary is now $6325 for his roster. Participant A feels he has a good line up if he can acquire a better wide receiver and tight end, but he has to work with and stay in his salary cap. Participant A decides to get a more talented wide receiver from the exchange by selling player 13 to the exchange for $500 and buying player 20 for $800 from the exchange. After one round his team's salary is $6300.

DRAFT ROUND TWO: In this round Participant B buys a defensive back from the exchange, player 48, for $900 and sells player 52 to the exchange for $700. His salary increased to $6525. In round two, Participant A really wants Participant B's tight end so he offers Participant B player 40 valued at $600 for Participant B's player 39, who is valued at $1000, and give B $500. This offer is $100 more than the exchange valuation so Participant B accepts the offer because Participant B thinks tight end player 42 in the pool of tight ends is undervalued at $850 and Participant B is the next to draft. This puts Participant A's salary at $6800.

DRAFT ROUND THREE: Participant B begins round three with tight end player 40 valued at $600 plus an additional $500 increase in salary cap. Participant B buys tight end player 42 for $850 from the exchange and sells player 40 for $600 to the exchange. Participant B's salary cap increased by $250 dollars to $7250, Participant B's team salary is $6525. Participant A is up against his team's salary cap but really likes his team. Participant A's team salary is at $6800 and he has one more draft. He decides he will draft wide receiver player 19, valued $900 and sell player 20 that he had purchased earlier for $800. The deal will cost him $100, so he is bumping his salary cap of $7000 at a base salary of $6900. He is really hoping that the taxi squad player will really have some value.

TAXI SQUAD: When the draft is complete, the exchange randomly assigns one player apiece for both participants from the entire pool of position players as their taxi squad. These taxi squad players can be traded or sold to the exchange or the other participant for another position player as long as a taxi squad member is maintained on each team. In this exemplary embodiment, Participant A was awarded player 26, a running back with a value of $800. Participant B was awarded player 9, a wide receiver with value of $700. Players on the taxi squad can accumulate points as well as have takeaway points for negative performance as described in the scoring section. A player on the taxi squad that has accumulated either positive or negative points must be activated to the starting lineup and the position player he replaces (they both must play the same position) must be put on waivers at the value the exchange has on him. If he is not picked up off waivers, then he remains on the participant's team as a taxi squad member and can be sold or traded to the exchange or to the other participant. If he is picked up off waivers by the opposing participant the exchange simultaneously randomly assigns a position player to the participant's taxi squad.

The scoring in this example is offense-centered, with take away scoring for negative performance by offense players. Take away scoring deduct points from a participant's fantasy score upon the occurrence of certain predetermined event. The take away scoring in this football example is as follows: −1 for a fumble, −3 if the fumble is recovered by the defense, −2 for dropped pass (a drop can be determined by the exchange), −2 for a missed extra point, −2 for safety by offensive player, −1 for missed field goal under 40 yards, −½ for missed field goal over 40 yards. The ½ point could be the determining tie breaking factor in preventing what would otherwise be a tie game between the contestants. On the offense side of scoring, in this football example, the exchange has set the following point system in our example; 6 points for a touchdown, 12 points for a touchdown if the passer and receiver are on the same real world team and on the participant's fantasy team as well, 4 points for an interception, 2 points for a 0-40 yard field goal, 3 points for a 41-50 yard field goal, and 4 points for a field goal greater than 50 yards. There are other unique scoring possibilities described herein.

In a preferred embodiment, if a player in the pool of position players creates a score and is not a member of a fantasy team, that amount of the score remains with the player and the player can be bought or traded for by the participants to obtain the player's credited points, which can be added to the participant's overall score when the player is acquired and added to the participant's active roster. Take away scoring can also be carried by a position player in the pool that is not on a team. In other words, players in the position player pool that are not activated on a team or on a taxi squad can still be credited for their scoring performance and have the credited points as a player as well as the increase in value and rating by the exchange. Also, players of a similar status that have take away points can retain these points along with decrease in value and performance rating by the exchange. Once any position player is an activated player to the starting lineup on a team, the credited points and negative points of the position player stay with the team, regardless of whether they are sold or traded. The starting lineup can be in constant flux depending on the performance of the position players and the trading acumen of the participants. In an alternative embodiment, only points earned or lost while a position player is on a participant's active roster will be included in the score of the participant's team. A participant may enter multiple games of head-to-head competition using a roster already established against another participant, but can only buy, sell, or trade from the position player pool that originated the roster.

In the third phase of the exemplary daily fantasy football embodiment, the specific games that the position players are chosen from will be in progress. The value of all position players will be updated in real-time according to their performance in the real-world game. Both participants may trade position players or buy position players from and sell position players to each other. Additionally, participants can sell position players to, buy position players from, and trade position player with the exchange at the price the exchange is quoting for the position player on a bid basis as the real-world games progress. In the preferred embodiment, a full roster must be maintained at all times.

At kickoff of the first game in the example of the four game, eight team fantasy competition, the exchange is open for trading with values and performance ratings of the selected pool of position players being updated in real-time as the real-world games progress. The games are now being played. In the second possession of the third real-world game of the four games in the fantasy competition, Participant A's defensive back/special team player (position player 47) runs a punt return back for a touchdown to add 6 points to Participant A's scoring column. Position player 47 has earned 6 points from the touchdown, so the value and rating of the special team player 47 has increased. So Participant A decides to make a trade with position player 47. Participant A decides to trade position player 47 to the exchange for the $1200 valuation for which the exchange values him and for position player 51 in the pool for $800. Participant A now has $400 extra dollars to add to his salary cap which gives him a $7400 cap and salary of $6800.

Participants A and B could be monitoring the progress of the fantasy competition on computers at home or on hand held devices, for example, at an actual game. Any device suitable for transmitting, receiving, and displaying information from the internet is suitable for monitoring the progress of the fantasy sports competition, including, but not limited to, desktop computers, laptop computers, video game consoles, arcade game consoles, network-connected televisions, smartphones, tablets, and wearable smart devices. Regardless of the device being used, the exchange can provide at least some applications that provide a trading and wagering marketplace demonstrating a realistic graphical scale with a high degree of verisimilitude to a brick and mortar establishment. This marketplace could create a virtual/augmented reality where the participant/bettor would feel they were actually in this virtual marketplace, placing wagers and interacting with others. The marketplace could facilitate using voice commands to execute marketplace and wagering orders, as well as AI products to enhance the decision making process. The screens of the devices will be capable of displaying for each participant at least some wagering information related to the fantasy competition. Exchange wagering information related to the fantasy competition can include real-time odds and percent probabilities, statistical probabilities, player modeling, binary probabilities (wisdom of crowds), and all types of collective intelligence for team combinations of position players, as well as for the individual position players themselves to perform a specific activity on the field. In a preferred embodiment, there will be a trading screen or display on the main screen to show wagers, buys, sales, and trades, and all types of bankroll information related to the participants/bettors, scoring and changes of the score, available cap money, real-time value and performance rating of individual players, performance rating of the teams, and any other features related to the fantasy/eSports competition to enhance the play of the participants. The trading screen is akin to a stock or commodity traders trading screen on a trading floor, and the action can be the same as stock or commodity prices fluctuating up and down during a trading day as the actual football games progress and the value and performance ratings of the individual position players fluctuate up and down according to their-on-the-field performance.

FIG. 1 is a flowchart showing a computer-implemented method in accordance with one or more embodiments of the present invention. The method starts at 102 and proceeds to step 104. At step 104, a set of real world-players is determined. That is, the real-world players eligible for scoring the fantasy competition are identified. For example, if the fantasy competition is based on the performance of real-world players in the National Football League (NFL), then the NFL players whose real-world performance in NFL football games are to be used for scoring the fantasy competition are determined. The set of real-world players can comprise all NFL players or a selection of NFL players determined by the exchange. If the fantasy competition is based on eSports, such as a Defense of the Ancients (DOTA) tournament, then the players or teams competing in the DOTA tournament whose real-world performance in the DOTA tournament are to be used for scoring in the fantasy competition are determined.

At step 106, a value is assigned for each of the real-world players in the set of real world players. At step 108, a salary cap is determined for the fantasy competition. The salary cap is the limit on the sum of the values of the active players selected for an active roster. At step 110, real-world players are randomly assigned to a team roster associated with a participant of a fantasy competition. The team roster comprises the active roster and the taxi squad, as described above. At step 112, subsequent to randomly assigning real-world players to a team roster associated with a participant of a fantasy competition, a draft is performed in which the participants of the fantasy competition select real-world players from the set of players who were not randomly assigned by the exchange to a team roster associated with a participant. At step 114, one or more real-world players are randomly assigned to the taxi squad associated with a participant of a fantasy competition. At step 116, for each team roster associated with a participant, an indication of the real-world players assigned to the active roster is received. The performance of the real-world players assigned to the active roster are used for scoring the fantasy competition. At step 118, a determination is made as to whether the combined value of the real-world players assigned to the active roster exceeds the salary cap. At step 120, the fantasy competition is performed. The score for each team roster associated with the fantasy competition participants is based on the performance, in one or more real-world events, of the real-world players assigned to the active roster associated with the team roster.

Figure 2:
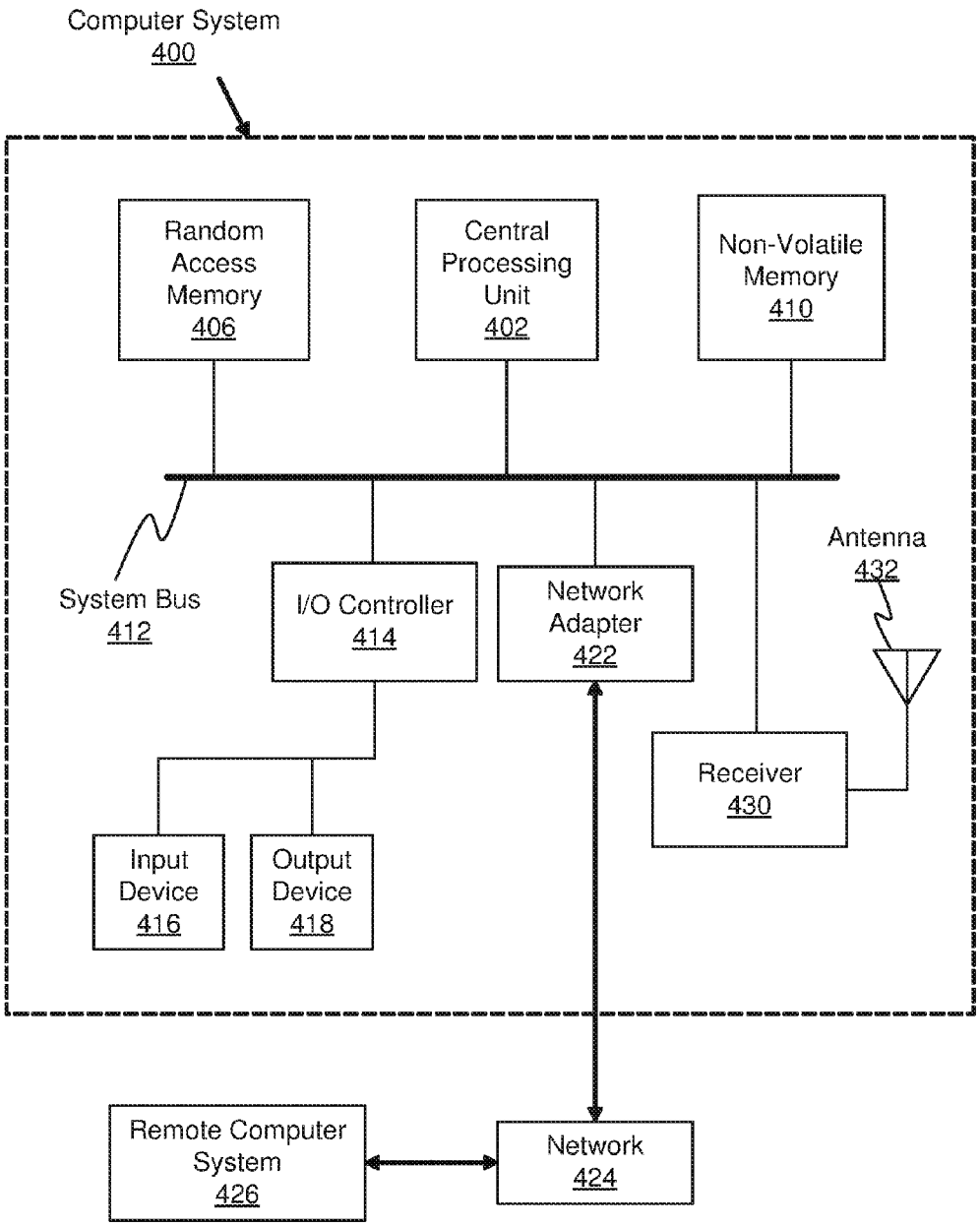
FIG. 2 is a block diagram showing a computer system 400 suitable for storing and/or executing a computer program in accordance with embodiments of the present invention.

At least one embodiment of the present invention is directed to a computer program encoded in a computer-readable memory. The computer program comprises computer-executable instructions that, when executed, causes one or more computer systems to perform embodiments of the present invention described herein. The term "computer system" as used herein refers to any data processing system or computer system including, but not limited to, personal computers (PC), file servers, cloud computing systems, software-as-a-service (SaaS) systems, cellular telephones, smartphones, tablet devices, laptop computers, personal digital assistants, and the like. FIG. 2 is a block diagram showing a computer system 400 suitable for storing and/or executing a computer program in accordance with embodiments of the present invention. Computer system 400 includes a central processing unit 402 having at least one microprocessor. Central processing unit 402 can be coupled directly or indirectly to memory elements through system bus 412. The memory elements comprise computer-readable memory capable of storing computer-executable instructions. The memory elements can include random access memory 406 employed during the actual execution of the program code and non-volatile memory 410 for longer term storage of data and instructions. One or more input devices 416 and output devices 418 can be coupled to system bus 412 either directly or through an intervening I/O controller 414. Examples of input device 416 include, but are not limited to, a pointing device, such as a mouse or a trackpad, or a keyboard. Examples of input device 416 can also include an electronic number generating device for generating random numbers or pseudorandom numbers to be used where randomization is needed, such as randomly assigning real-world players to a team roster associated with a participant of a fantasy competition and randomly assigning one or more real-world players to a taxi squad associated with a participant of a fantasy competition. The number generator can comprise a hardware device connected to computer system 400, such as a universal serial bus (USB) dongle containing a circuit that generates random numbers or pseudorandom numbers. Examples of output device 418 include, but are not limited to, a display screen or a printer. Input device 416 and output device 418 can be combined into a single device comprising a touchscreen comprising a display screen (for displaying information to the user of computer system 400) having a touch-sensitive surface (for receiving input from the user). Network adapters 422 may also be coupled to computer system 400 to enable the system to become coupled to remote computer system 426 or remote printers or storage devices through intervening private or public networks 424. Modems, cable modems, Ethernet cards, and wireless network adapters are just a few of the currently available types of network adapters. Computer system 400 can include one or more receivers 430. Receiver 430 receives wireless signals via antenna 432. Receiver 430 is adapted for receiving a data signal from a transmitting device. Receiver 430 can comprise a transceiver capable of both transmitting and receiving wireless data signals. While various component devices of computer system 400 are shown as separate devices in FIG. 2 for purposes of description, various component devices may be integrated into a single device as is known in the art, such as in a system-on-a-chip (SoC) device.

Although the present invention and its advantages have been described in detail, it should be understood that various changes, substitutions and alterations can be made herein without departing from the scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim as follows:

1. A computer-implemented method for providing an exchange-traded, online fantasy competition comprising:

providing an online, computer-implemented exchange in which the exchange is programmed to receive funds and provide all bankroll information, trades, and wagers using no-default clearing and no-default wagering and to clear trades and wagers between participants substantially in real-time;

determining, by the exchange, a set of real-world players eligible for scoring in an online fantasy competition;

assigning, by the exchange, a value for each of the real-world players in the set of real-world players;

determining, by the exchange, a salary cap for the fantasy competition, the salary cap comprising a limit on a sum of the values of the real-world players selected for an active roster;

randomly assigning, by the exchange using a circuit that generates random numbers, real-world players to a team roster associated with a participant of a fantasy competition, the team roster comprising the active roster and a taxi squad;

subsequent to randomly assigning real-world players to a team roster associated with a participant of a fantasy competition, performing a draft in which the participants select real-world players from the set of position players who were not randomly assigned by the exchange to a team roster associated with a participant;

randomly assigning, by the exchange using a circuit that generates random numbers, one or more real-world players to a taxi squad associated with a participant of a fantasy competition;

receiving, by the exchange, for each team roster associated with a participant, an indication of the real-world players assigned to the active roster, the performance of the real-world players assigned to the active roster being used for scoring the fantasy competition;

determining, by the exchange, whether the combined value of the real-world players assigned to the active roster exceeds the salary cap; and performing a fantasy competition in which a score for each team roster associated with a participant is based on the performance, in one or more real-world events, of the real-world players assigned to the active roster associated with the team roster and in which the value assigned to each player by the exchange is updated and displayed to participants substantially in real-time as the one or more real world events are in progress;

in which the circuit that generates random numbers comprises a universal serial bus dongle.

2. The method of claim 1 further comprising, subsequent to randomly assigning real-world players to a team roster associated with a participant of a fantasy competition, receiving an indication of a player trade in which a first real-world player on a team roster associated with a participant is replaced with a second real-world player, in the set of real-world players eligible for scoring in a fantasy competition, who is not on the team roster associated with the participant.

3. The method of claim 1 further comprising receiving one or more wagers based on the outcome of the fantasy competition.

4. The method of claim 1 in which the fantasy competition is a daily fantasy competition.

5. The method of claim 1 in which the fantasy competition is a season-long fantasy competition.

6. The method of claim 1 in which a set of rules for the fantasy competition is set by the participants of the fantasy competition.

7. The method of claim 1 in which a set of rules for the fantasy competition is set by the participants of the fantasy competition.

8. The method of claim 1 in which the exchange provides transparent risk management for player selection by comparing a player selection by a participant to a model provided by the exchange for the player.

9. The method of claim 8 further comprising displaying to the participant information from a group consisting of: a performance rating of other participants in the fantasy competition, news stories related to the player, social media mentions related to the player, ownership percentages of the player by other participants in the fantasy competition, binary markets, and contrary opinion markets.

10. The method of claim 1 in which fantasy players are traded as the one or more real world events are in progress.

11. The method of claim 1 in which wagers are placed as the one or more real world events are in progress.

12. The method of claim 1 in which the exchange provides for wagering on outcomes of the fantasy event selected from a group consisting of: win probability style wagering, exchange style wagering, binary wagering based on the wisdom of crowds theory, and fixed odds wagering.

13. The method of claim 12 in which the exchange provides for the selling of wagers.

14. The method of claim 1 in which the real-world event comprises a video game eSports competition.

15. The method of claim 14 in which the set of real-world players eligible for scoring in the online fantasy competition is comprised of players performing in the video game eSports competition.

16. A computer system for providing a fantasy competition comprising:

a computer processor;

a circuit that generates random numbers communicatively coupled to the processor, the circuit comprising a universal serial bus dongle;

a computer-readable memory communicatively coupled to the processor, the computer-readable memory encoded with computer-executable instructions that, when executed by the computer processor, cause the computer system to perform the steps of:

providing an online, computer-implemented exchange in which the exchange is programmed to receive funds and provide all bankroll information, trades, and wagers using no-default clearing and no-default wagering and to clear trades and wagers between participants substantially in real-time;

determining, by the exchange, a set of real-world players eligible for scoring in a fantasy competition;

assigning, by the exchange, a value for each of the real-world players in the set of real-world players;

determining, by the exchange, a salary cap for the fantasy competition, the salary cap comprising a limit on a sum of the values of the real-world players selected for an active roster;

randomly assigning, by the exchange using the circuit that generates random numbers, real-world players to a team roster associated with a participant of a fantasy competition, the team roster comprising the active roster and a taxi squad;

subsequent to randomly assigning real-world players to a team roster associated with a participant of a fantasy competition, performing a draft in which the participants select real-world players from the set of position players who were not randomly assigned by the exchange to a team roster associated with a participant;

randomly assigning, by the exchange using the circuit that generates random numbers, one or more real-world players to a taxi squad associated with a participant of a fantasy competition;

receiving, by the exchange, for each team roster associated with a participant, an indication of the real-world players assigned to the active roster, the performance of the real-world players assigned to the active roster being used for scoring the fantasy competition;

determining, by the exchange, whether the combined value of the real-world players assigned to the active roster exceeds the salary cap; and performing a fantasy competition in which a score for each team roster associated with a participant is based on the performance, in one or more real-world events, of the real-world players assigned to the active roster associated with the team roster and in which the value assigned to each player by the exchange is updated and displayed to participants substantially in real-time as the one or more real world events are in progress.

17. The computer system of claim 16 further comprising, subsequent to randomly assigning real-world players to a team roster associated with a participant of a fantasy competition, receiving an indication of a player trade in which a first real-world player on a team roster associated with a participant is replaced with a second real-world player, in the set of real-world players eligible for scoring in a fantasy competition, who is not on the team roster associated with the participant.

18. The computer system of claim 16 further comprising receiving one or more wagers based on the outcome of the fantasy competition.

19. The computer system of claim 16 in which the fantasy competition is a daily fantasy competition.

20. The computer system of claim 16 in which the fantasy competition is a season-long fantasy competition.

21. The computer system of claim 16 in which a set of rules for the fantasy competition is set by the participants of the fantasy competition.

22. The computer system of claim 21 in which a set of rules for the fantasy competition is set by the participants of the fantasy competition.

23. The computer system of claim 22 further comprising displaying to the participant information from a group consisting of: a performance rating of other participants in the fantasy competition, news stories related to the player, social media mentions related to the player, ownership percentages of the player by other participants in the fantasy competition, binary markets, and contrary opinion markets.

24. The computer system of claim 16 in which the exchange provides transparent risk management for player selection by comparing a player selection by a participant to a model provided by the exchange for the player.

25. The computer system of claim 16 in which fantasy players are traded as the one or more real world events are in progress.

26. The computer system of claim 25 in which the exchange provides for the selling of wagers.

27. The computer system of claim 16 in which wagers are placed as the one or more real world events are in progress.

28. The computer system of claim 16 in which the exchange provides for wagering on outcomes of the fantasy event selected from a group consisting of: win probability style wagering, exchange style wagering, binary wagering based on the wisdom of crowds theory, and fixed odds wagering.

29. The computer system of claim 16 in which the real-world event comprises video game eSports competition.

30. The computer system of claim 29 in which the set of real-world players eligible for scoring in the online fantasy competition is comprised of players performing in the video game eSports competition.

* * * * *